US011214932B2

(12) United States Patent
Polom et al.

(10) Patent No.: US 11,214,932 B2
(45) Date of Patent: Jan. 4, 2022

(54) OVER DECKING SYSTEMS AND METHODS

(71) Applicant: United States of America as Represented by The Secretary of The Army, Alexandria, VA (US)

(72) Inventors: Jonathan M. Polom, Grosse Pointe Woods, MI (US); Ashley L. Genna, Macomb, MI (US); Justin S. Strickler, Clinton, MS (US); Gary E. Johnston, Rayville, LA (US)

(73) Assignee: UNITED STATES of AMERICA AS REPRESENTED BY THE SECRETAY OF THE ARMY, Alexandria, VA (US)

( * ) Notice: Subject to any disclaimer, the term of this patent is extended or adjusted under 35 U.S.C. 154(b) by 27 days.

(21) Appl. No.: 16/861,145

(22) Filed: Apr. 28, 2020

(65) Prior Publication Data

US 2021/0332537 A1 Oct. 28, 2021

(51) Int. Cl.

| | |
|---|---|
| ***E01D 15/00*** | (2006.01) |
| ***E01D 15/133*** | (2006.01) |
| ***E01D 19/12*** | (2006.01) |
| ***E01D 19/04*** | (2006.01) |
| ***E01D 2/02*** | (2006.01) |

(52) U.S. Cl.
CPC ..... *E01D 15/133* (2013.01); *E01D 2/02* (2013.01); *E01D 19/048* (2013.01); *E01D 19/125* (2013.01)

(58) Field of Classification Search
CPC ..... E01D 2/02; E01D 15/133; E01D 19/048; E01D 19/125
USPC ..... 14/2.4–6, 14, 73–77.1
See application file for complete search history.

(56) References Cited

U.S. PATENT DOCUMENTS

| | | | | | |
|---|---|---|---|---|---|
| 33,629 | A | * | 11/1861 | Avery | 14/6 |
| 150,327 | A | * | 4/1874 | Josel | E01D 1/005 14/6 |
| 308,501 | A | * | 11/1884 | Kersten | 14/6 |
| 314,900 | A | * | 3/1885 | Wilson | 14/6 |
| 428,338 | A | * | 5/1890 | Hill | 14/6 |
| 530,425 | A | * | 2/1895 | Clymer | E01D 2/04 14/6 |
| 3,103,025 | A | * | 9/1963 | Gassner | E01D 19/041 14/6 |
| 4,282,619 | A | * | 8/1981 | Rooney | E01D 2/04 14/6 |
| 5,024,036 | A | * | 6/1991 | Johnson | A47B 47/04 405/262 |
| 5,340,032 | A | * | 8/1994 | Stegmaier | F02M 61/165 239/575 |

(Continued)

*Primary Examiner* — Raymond W Addie
(74) *Attorney, Agent, or Firm* — Brian C. Jones

(57) ABSTRACT

A decking system provides a surface upon which traffic may travel. Drivable decking surfaces can support heavy vehicles, such as tanks. Exemplary decking systems include a first module, a second module, a first upper fastening assembly, a first lower fastening assembly, a second upper fastening assembly, and a second lower fastening assembly. These fastening assemblies can secure the first module and the second module together. Decking systems may also include side ramp assemblies and/or end ramp assemblies, and such ramp assemblies can be coupled with a decking platform. Fastening assemblies may include a pin, a first clip, and a second clip.

20 Claims, 12 Drawing Sheets

(56) References Cited

U.S. PATENT DOCUMENTS

| | | | | |
|---|---|---|---|---|
| 5,680,664 | A * | 10/1997 | Head | E01D 1/00 14/4 |
| 10,161,090 | B2 * | 12/2018 | Lee | E01D 21/065 |
| 2004/0055249 | A1 * | 3/2004 | Kennedy | B32B 7/08 52/794.1 |

* cited by examiner

OVER DECKING SYSTEMS AND METHODS

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to decking techniques, and, more particularly but not exclusively, to decking systems and methods that can be used to provide usable surfaces across uneven terrain and compromised pre-existing surfaces, and adjacent to railway lines, loading docks, roads, waterways, and other transportation modalities and shipping surfaces.

Description of the Related Art

This section introduces aspects that may help facilitate a better understanding of the invention. Accordingly, the statements of this section are to be read in this light and are not to be understood as admissions about what is prior art or what is not prior art. Decking systems are well known in the transportation industry. Vehicular bridges, for example, include decking surfaces upon which traffic may travel. Currently known deck systems include timber deck systems, concrete decks which may either be precast or cast in place, and metal decks. Decking systems typically include a decking surface, which is held above the ground or another structure by way of a support assembly.

Existing decking systems and methods are helpful in providing surfaces for vehicles to drive upon. Yet still further improvements in decking technology are desired. Embodiments of the present invention provide solutions for at least some of these outstanding needs.

SUMMARY

The present invention was developed to address the challenges associated with existing decking systems and offloading of railcars or truck/trailers. For example, decking systems and methods as disclosed herein are well suited for use in providing drivable surfaces across which heavy vehicles, such as military tanks, can travel. Research and development has led to a novel approach for constructing decking systems.

The present invention advances the science of decking systems and methods. This disclosure describes a new decking system intended to replace currently known decking systems. Particular focus will be placed on the adjustable and configurable nature of the decking system and the method in which the decking system can be assembled and installed at various desired locations. The decking systems presented here are shown to be more versatile, adaptable, and effective than prior decking systems. What is more, the instant decking systems are simple in construction, economical to fabricate, and easy to use, particularly in a time-efficient manner.

Existing decking systems may be used in transportation areas where the terrain is flat and consistent. However, in certain circumstances, such as during wartime, it may be desirable to construct a decking system across terrain which is uneven, across structurally compromised pre-existing transportation surfaces, and at locations which may otherwise be difficult to access. In such circumstances, it is advantageous to have a decking system that is adjustable, so that it can be used with any of a variety of terrain surfaces. Moreover, it is advantageous to have an adjustable decking system that can be quickly installed on whatever type of terrain might exist.

A novel decking system as disclosed herein may be used on conjunction with pile bridge and cap repair technologies, according to some embodiments. In some cases, decking systems as disclosed herein can be used to rehabilitate existing and/or damaged pier and wharf structures. Exemplary decking systems can be configured for use as a railhead and semi-trailer loading dock configuration. In some cases, certain of the girder support members are angular to facilitate ramping and add even more versatility.

During military operations, the U.S. military may need to use existing infrastructure to support its operations, such as the off-loading and on-loading of heavy vehicles, machinery, and other materials from and to ships using existing piers, which might not be strong enough to support those loads, due to damage or deterioration of the pier materials. Embodiments of the present invention provide decking systems and methods which can operate to supplement and/or replace existing piers. Decking systems as disclosed herein can be installed by a few installers without the use of heavy machinery.

During military operations, it may be required to project US forces to multiple- and unexpected entry points throughout denied theaters. Rail is a critical modality for this purpose in developed theaters. To establish surprise and/or overcome barriers from existing damaged railheads, an expedient means is required to establish train-to-ground trans-load points. Existing ramping systems are not conducive for this purpose. This decking system as disclosed herein, provides a rapidly-constructed and scalable capability for rail trans-loading in austere environments.

The U.S. military and humanitarian organizations are tasked to provide rapid response capability across various austere locations. Such capabilities often require transportation infrastructure modalities such as bridges and loading docks. Existing designs may, however, involve complex logistics, design, and contracting time requirements, resulting in increased efficiencies for military and disaster relief operations. Relatedly, such existing designs may not provide deployed military or humanitarian responders with the ability to quickly adapt to a wide variety of possible transportation and/or shipping requirements and environments. For example, existing decking systems that involve standard timber frame and masonry can require skilled laborers or lengthy construction times.

Moreover, conventional decking structures often require the availability and use of power tools or heavy equipment for purposes of assembly. The kit embodiments disclosed herein are quickly deployable, and can provide adjustable structures, thus providing the advantages of quick deployment.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Figure 1:
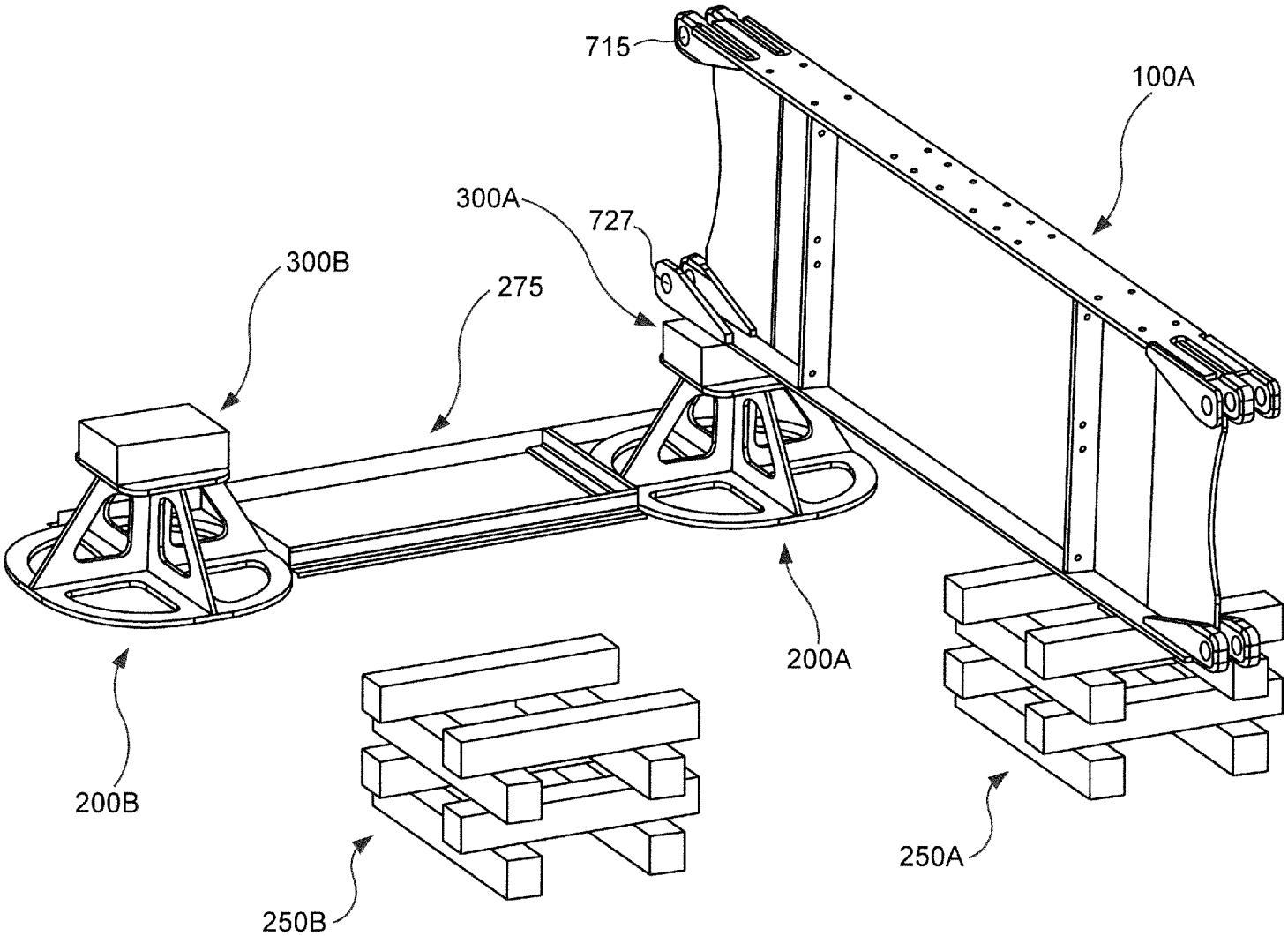
FIG. 1 depicts aspects of a method for assembling a decking system, according to certain embodiments of the invention.

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

In at least one embodiment, the present invention aims to address the shortcoming of existing tie-down devices by providing a tie-down device that can easily be used with a wide variety of aircraft parking or mooring areas which may have concrete slabs of varying or unknown thicknesses.

The on-site assembly of standardized and modular construction components as disclosed herein can greatly decrease logistics, design and contracting time, resulting in increased efficiencies for military and disaster relief operations. These technologies, techniques, and processes enable highly mobile deployed military or humanitarian responders to have the ability to quickly adapt to all possible transportation and shipping requirements and environments. The kit embodiments disclosed herein are quickly deployable, and can provide adjustable and easily assembled structures. Compared to traditional construction methods, like timber frame and masonry, kit embodiments disclosed herein do not require skilled laborers or lengthy construction times. Unlike conventional transportation structures, there is no need for power tools or heavy equipment to assemble or erect these kit structures. A novel decking kit can be easily and quickly assembled, and can utilize innovative geometry to minimize shipping volume and construction time. Embodiments of the present invention encompass modular assembly decking kits, and methods for their use and manufacture. Exemplary embodiments provide a modular, portable, lightweight, and flexible system, including an assembly of standardized components, that can be quickly assembled to create a decking structure, and that can also be disassembled quickly. Embodiments of the present invention encompass kits of parts that can be conveniently and efficiently packaged for transport. According to some embodiments, kits are well suited for use with mobile forces and with humanitarian efforts. Contingency bases and emergency response teams can use the decking kits for rapid transportation and loading/unloading needs.

In some cases, a decking system or kit can provide a bridging system that is reconfigurable to any of a variety of desired configurations. Exemplary decking systems include deck panels which operate as a top surface, girders which provide structural support to the deck panels, and pin assemblies which provide connections between the girders. A decking system can provide a bridge over a gap in a damaged pier, for example. In such instances, the decking system allows vehicles to be driven over the damaged pier, without having to repair the pier. In some cases, the gap in the pier may be quite large, for example spanning 70 feet or more.

Decking System Assembly

FIG. 1 depicts a perspective view of a partially assembled decking system, according to embodiments of the present invention. As shown here, assembly of the decking system can begin with placing a first spreader 200A at a desired location, for example near the shore of a waterway to be traversed, or near the edge of a pier gap to be traversed. In such instances, the assembled decking system can be used to traverse the waterway or pier gap. The location for constructing the decking system can be selected following a site surveying operation.

As shown in FIG. 1, a first dunnage 250A can be placed near the first spreader 200A. In the embodiment depicted here, first dunnage 250A includes 8 pieces of composite lumber, with four layers of lumber pieces, each layer having two pieces. Dunnage can provide temporary support for one or more components of the decking system as it is assembled. A dunnage can include any desired material or number of components. In some cases, dunnage is made of wood. In some embodiments, dunnage is not included in a final completed assembly of a decking system. In some cases, the dunnage 250A is placed 72 inches from the spreader 200A. A first spacer 300A can be placed on top of the first spreader 200A. A first girder 100A can be placed on top of the first spacer 300A and the first dunnage 250A. In some cases, girder 100A may be referred to as a platform girder. A spacing aid 275 can be placed adjacent to the first spreader 200A, and a second spreader 200B can be placed adjacent to the spacing aid 275. In some cases, the spacing aid 275 can be configured to set the second spreader 200B about 59¼ inches from the first spreader 200A. A second spacer 300B can be placed on top of the second spreader 200B. A second dunnage 250B can be placed at a distance (e.g. 72 inches) from the second spreader 200B.

Figure 2:
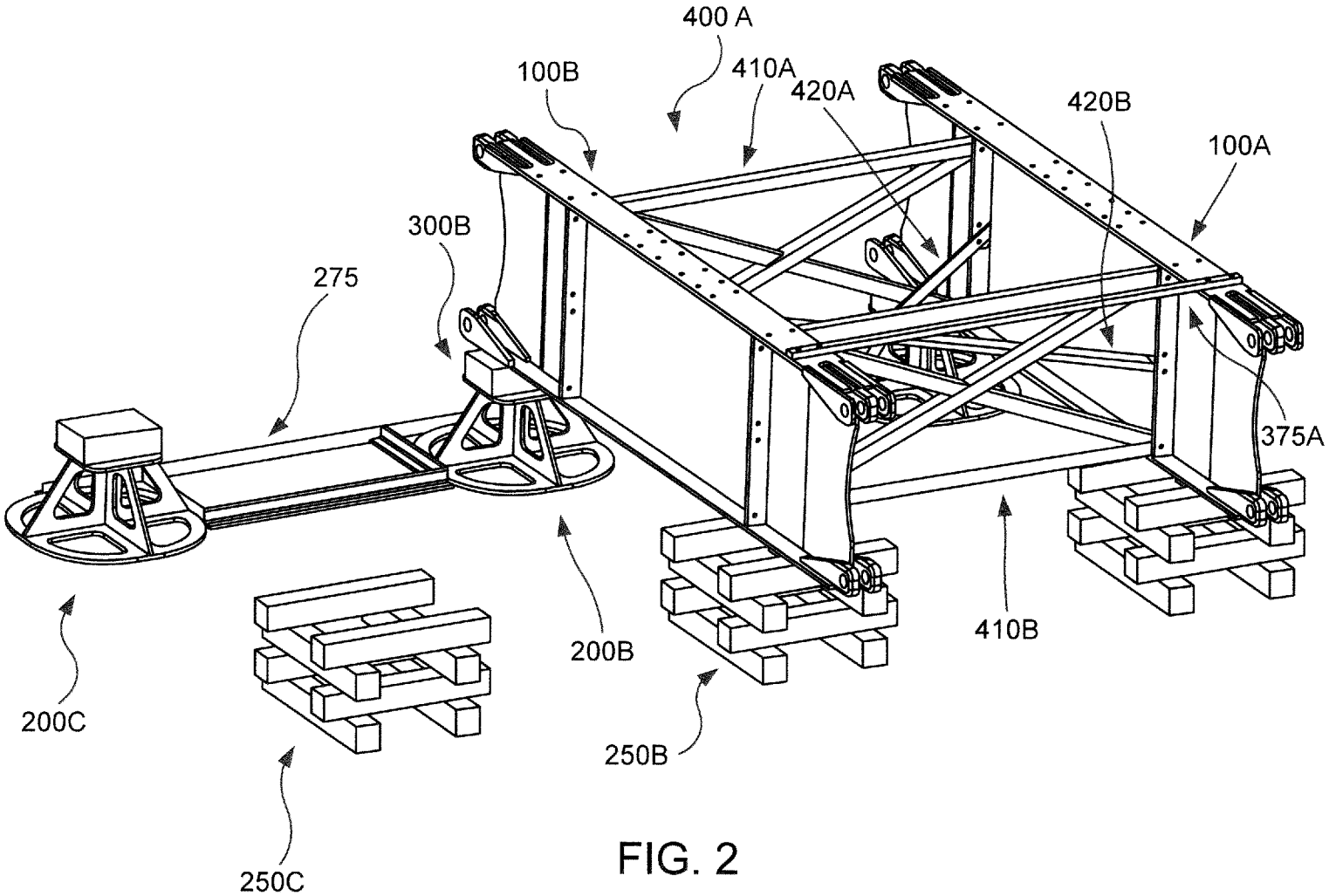
FIG. 2 illustrates aspects of a method for assembling a decking system, according to certain embodiments of the invention.

As shown in FIG. 2, a second girder 100B can be placed on top of the second spacer 300B and the second dunnage 2508. A first assembly aid 375A can be placed between the first girder 100A and the second girder 100B, or can otherwise be used to provide a desired spacing distance between the first girder 100A and the second girder 100B. A bracing assembly 400A can be disposed between the first girder 100A and the second girder 100B. As shown here, bracing assembly 400A includes a first cross bracing assembly 410A and a second cross bracing assembly 410B. Bracing assembly 400A also includes a first longitudinal brace 420A and a second longitudinal brace 420B. The first cross bracing assembly 410A and the second cross bracing assembly 410B can be placed between and coupled with the first girder 100A and the second girder 100B. The first longitudinal brace 420A and the second longitudinal brace 420B can be placed between and coupled with the first girder 100A and the second girder 100B. In some cases, the two cross bracing assemblies can be coupled with the girders using eight 1¼" bolts and eighth ½" nuts. In some cases, the two longitudinal braces can be coupled with the girders using five 1¾" bolts and five ½" nuts. The spacing aid 275 can be used to set the third spreader 200C at a desired distance (e.g. 59¼) from the second spreader 200B. A third dunnage 250C can be placed at a desired distance (e.g. 72 inches) from the third spreader 200C.

In use, a girder can operate to provide a main horizontal support for a span assembly or deck panel. A deck panel can provide a roadway portion of a ramp or span assembly. A support weldment, or spreader, can provide a main support for a girder span assembly. A lateral cross bracing can provide a main span bracing between two girders. A longitudinal bracing can provide a bracing between two girders. A pin can be used to connect two girders together.

Figure 3:
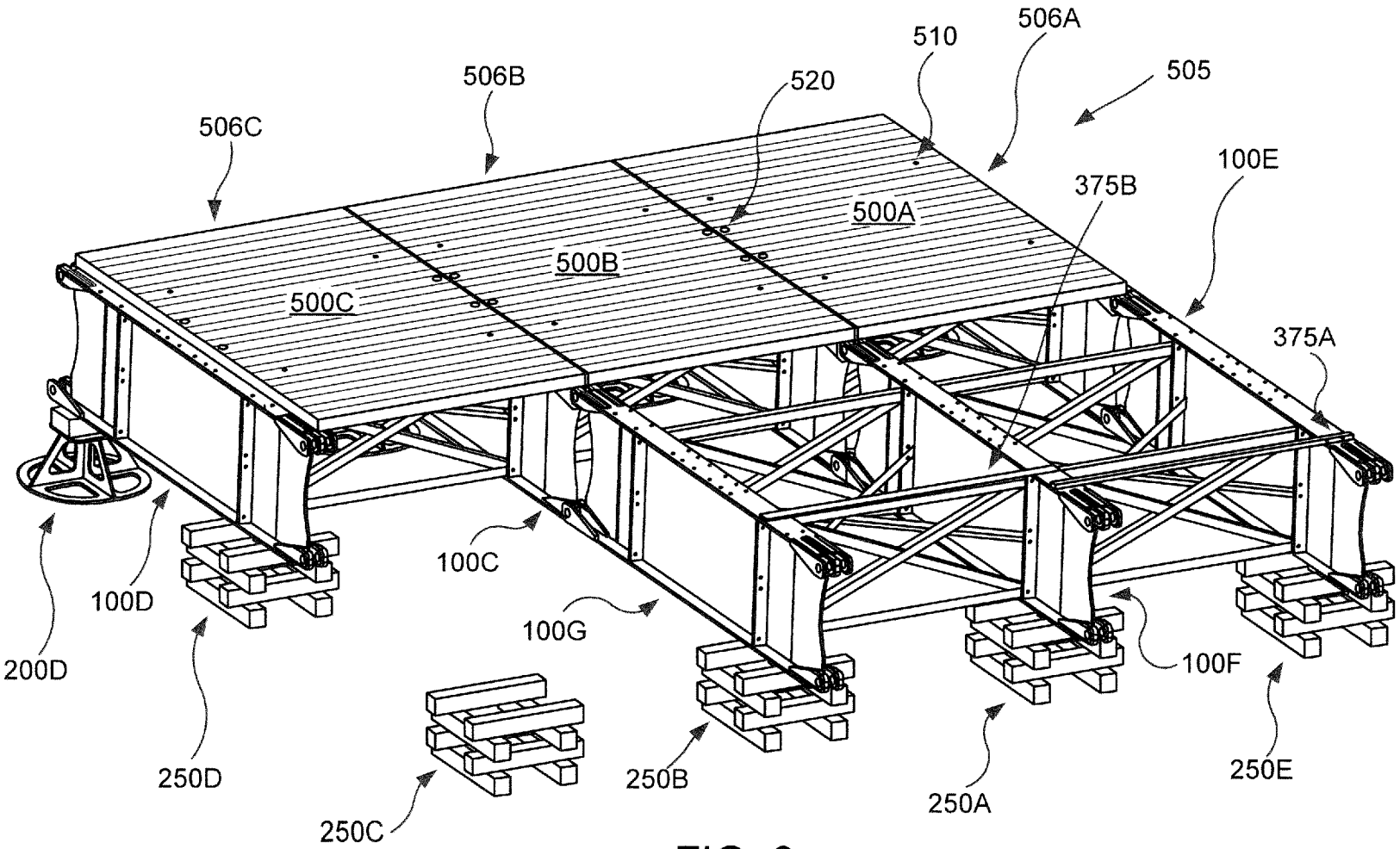
FIG. 3 illustrates aspects of a method for assembling a decking system, according to certain embodiments of the invention.

As shown in FIG. 3, a third girder 100C can be added to the decking system. For example, the third girder 100C can be placed on top of a spacer and a dunnage in a manner as described elsewhere herein. An assembly aid can be placed between the second girder and the third girder. A bracing assembly can be placed between and coupled with the second girder and the third girder, in a manner as described elsewhere herein. In some cases, two cross bracing assemblies can be coupled with the second and third girders using eight 1¾" bolts and eight ½" nuts. In some cases, two longitudinal braces can be coupled with the second and third girders using five 1¾" bolts and five ½" nuts. A spacing aid can be used to set a fourth spreader 200C at a desired distance (e.g. 591/4 inch) from a third spreader. A fourth dunnage 250D can be placed as a desired distance (e.g. 72 inches) from the fourth spreader 200D. A fourth girder 100D can be added to the decking system. An assembly aid can be placed between the third girder 100C and the fourth girder 100D to provide the desired spacing between the third girder 100C and the fourth girder 100D. A bracing assembly can be placed between and coupled with the third girder and the fourth girder, in a manner as described elsewhere herein. In some cases, two cross bracing assemblies can be coupled with the third and fourth girders using eight 1¾" bolts and eight ½" nuts. In some cases, two longitudinal braces can be coupled with the third and fourth girders using five 1¾" bolts and five ½" nuts. In this way, a bay having a width of three panels can be constructed. If wider bays, e.g. having four or more panels, are desired, additional spreaders, dunnages, girders, and bracing assemblies can be added. When the desired bay width is achieved (here, depicted in a three deck panel embodiment), the assembly aids can be removed. Deck panels 500A, 500B, and 500C can be added to the decking system. First deck panel 500A is coupled with the first girder and the second girder. Second deck panel 500B is coupled with the second girder and the third girder. Third deck panel 500C is coupled with the third girder and the fourth girder. Each panel can be secured to the girders using four 4" bolts. As shown here, the first panel 500A can include apertures 510 through which bolts can be inserted. The first panel 500A can also include rivet nuts 510 that can be used for lifting the panel (and optionally, components which are attached with the panel). The second and third panels (or any other panel of the decking system) can include similar aperture and rivet nut features. As discussed elsewhere herein, a decking system can include multiple bays, where each bay include can include multiple modules. As shown here, the first bay 505 includes three modules 506A, 506B, and 506C. First module 506A is coupled with second module 506B and two incomplete modules of a second bay (the first and second incomplete modules). Second module 506B is coupled with first module 506A, third module 506C, and the two incomplete modules of the second bay. Third module 506C is coupled with the second module 506B and the second incomplete module of the second bay.

FIG. 3 depicts a partially assembled decking system having one completed first bay 505 (e.g. which includes three deck panels) and one partially completed second bay. To assemble the second bay, a fifth dunnage 250E is placed at a desired location (e.g. a desired distance from the first dunnage, where the first dunnage is still disposed beneath the first girder). In some cases, the fifth dunnage 250E may be placed 96 inches from the first dunnage. A fifth girder 100E can be added to the decking system, for example by coupling the fifth girder to first girder using two pins and four lynch pins. As shown here, the fifth girder 100E is also setting on top of the fifth dunnage 250E.

The first dunnage 250A can then be moved away from beneath the first girder to a new position, as depicted in FIG. 3, that is a desired distance from the second dunnage. To help remove the first dunnage from under the first girder, an operator or assembler can lift up on the first girder, for example by using hoist rings and/or a lift sling.

A sixth girder 100F can be added to the decking system, for example by coupling the sixth girder to second girder using two pins and four lynch pins. As shown here, the sixth girder 100F is also setting on top of the first dunnage 250A. A first place assembly aid 375A can be used to provide a desired spacing between the fifth girder 100E and the sixth girder 100F. A bracing assembly can be placed between and coupled with the fifth girder 100E and the sixth girder 100F, in a manner as described elsewhere herein. In some cases, two cross bracing assemblies can be coupled with the fifth and sixth girders using eight 1¾" bolts and eight ½" nuts. In some cases, two longitudinal braces can be coupled with the fifth and sixth girders using five 1¾" bolts and five ½" nuts.

The second dunnage 250B can then be moved away from beneath the second girder to a new position, as depicted in FIG. 3, that is a desired distance from the third dunnage. To help remove the second dunnage from under the second girder, an operator or assembler can lift up on the second girder, for example by using hoist rings and/or a lift sling.

A seventh girder 100G can be added to the decking system, for example by coupling the seventh girder to third girder using two pins and four lynch pins. As shown here, the seventh girder 100G is also setting on top of the second dunnage 250B. A second place assembly aid 3758 can be used to provide a desired spacing between the sixth girder 100F and the seventh girder 100G. A bracing assembly can be placed between and coupled with the sixth girder 100F and the seventh girder 100G, in a manner as described elsewhere herein. In some cases, two cross bracing assemblies can be coupled with the sixth and seventh girders using eight 1¾" bolts and eight ½" nuts. In some cases, two longitudinal braces can be coupled with the sixth and seventh girders using five 1¾" bolts and five ½" nuts.

The third dunnage 250C can then be moved away from beneath the third girder to a new position, as depicted in FIG. 3, that is a desired distance from the fourth dunnage. To help remove the third dunnage from under the third girder, an operator or assembler can lift up on the third girder, for example by using hoist rings and/or a lift sling.

Figure 6:
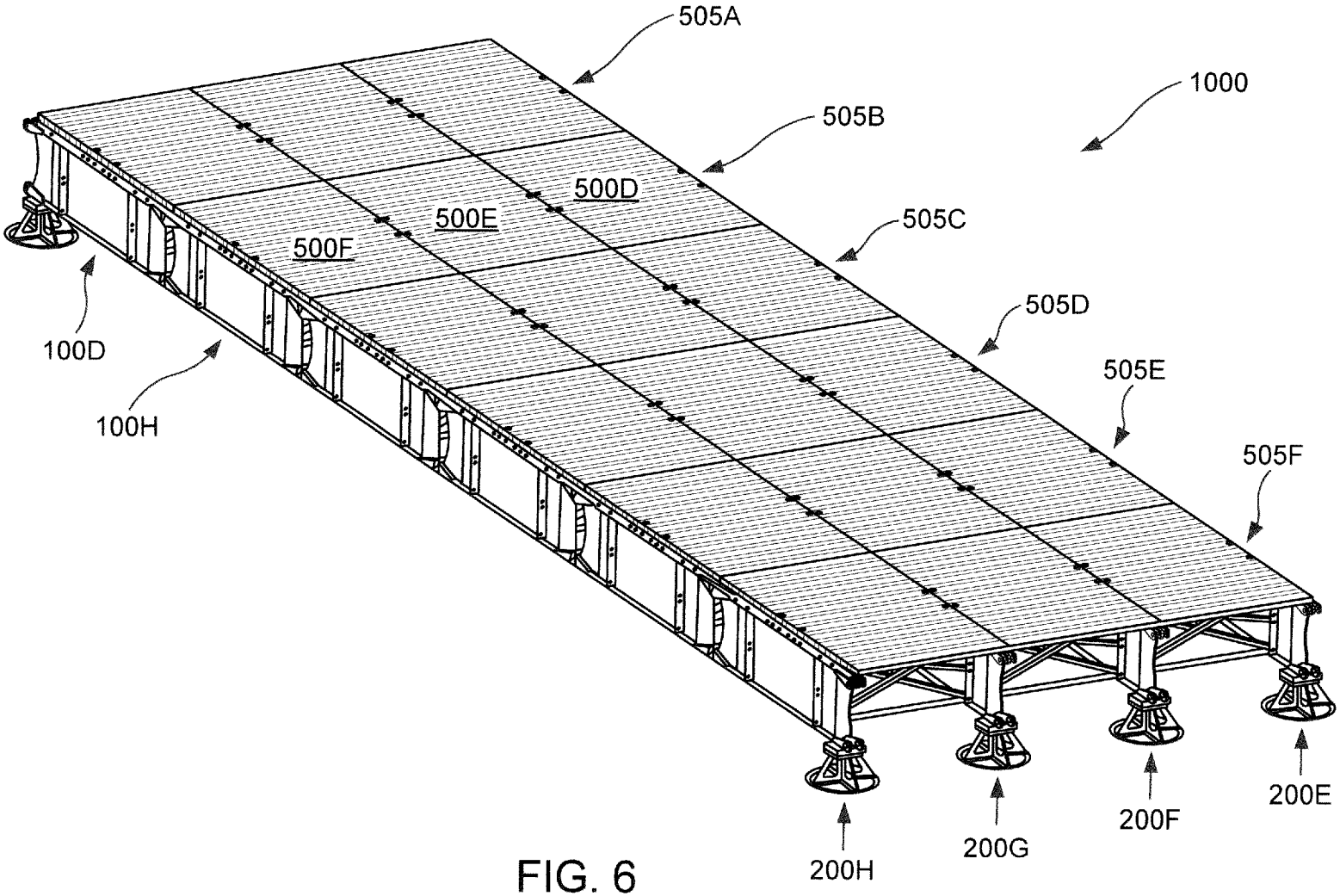
FIG. 6 depicts a decking platform of a decking system, according to certain embodiments of the present invention.

An eighth girder (e.g. girder 100H, as depicted in FIG. 6) can be added to the decking system, for example by coupling the eighth girder to fourth girder using two pins and four lynch pins. The eighth girder can also set on top of the third dunnage 250C. An assembly aid can be placed between the seventh girder 100G and the eighth girder to provide the desired spacing between the seventh girder 100G and the eighth girder. A bracing assembly can be placed between and coupled with the seventh girder and the eighth girder, in a manner as described elsewhere herein. In some cases, two cross bracing assemblies can be coupled with the seventh and eighth girders using eight 1¾" bolts and eight ½" nuts. In some cases, two longitudinal braces can be coupled with the seventh and eighth girders using five 1¼" bolts and five ½" nuts. In this way, a second bay having a width of three panels can be constructed. If wider bays, e.g. having four or more panels, are desired, additional spreaders, dunnages, girders, and bracing assemblies can be added. When the desired bay width is achieved (here, depicted in a three deck panel embodiment), the assembly aids can be removed. Deck panels 500D, 500E, and 500F (as depicted in FIG. 6) can be added to the decking system. Fourth deck panel 500D is coupled with the fifth girder and the sixth girder. Fifth deck panel 500E is coupled with the sixth girder and the seventh girder. Sixth deck panel 500F is coupled with the seventh girder and the eighth girder. Each panel can be secured to the girders using four 4" bolts. The deck panels can provide a decking surface upon which vehicular and other traffic may travel. In some cases, the deck panels can provide a drivable decking surface, and the decking system can support heavy vehicles, such as military tanks.

The above process can be repeated any number of desired times, so as to provide a decking system having any number of desired bays. For example, the decking system 1000 depicted in FIG. 6 has six bays, and each bay has three modules (e.g. where one module corresponds to one deck panel). Specifically, decking system 1000 includes a first bay 505A, a second bay 505B, a third bay 505C, a fourth bay 505D, a fifth bay 505E, and a sixth bay 505F. Each bay includes three modules. For example, second bay 505B includes three modules, where each module corresponds respectively to panels 500D, 500E, and 500F. The decking system includes spreaders disposed at both ends of the system. For example, in additional to spreaders 200A, 200B, 200C, and 200D as described elsewhere herein, decking system 1000 includes a fifth spreader 200E, a sixth spreader 200F, a seventh spreader 200G, and an eighth spreader 200H. According to some embodiments, the decking system 1000 depicted in FIG. 6 has a length of 100 feet. According to some embodiments, the decking system 1000 of FIG. 6 includes 48 girders, 12 spreaders, and 36 decking panels. In other configurations, a decking system may include one bay having a certain number of modules or deck panels, and another bay having a different number of modules or deck panels. Any desired configuration of bays and modules can be constructed. In this sense, a decking system can be a multi-module decking system. Exemplary multi-module decking systems can include a first module, a second module, a first upper fastening assembly, a first lower fastening assembly, a second upper fastening assembly, and a second lower fastening assembly. The first module can include a first girder having an upper coupling mechanism and a lower coupling mechanism, a second girder having an upper coupling mechanism and a lower coupling mechanism, a first longitudinal brace coupled with a first end portion of the first girder and a second end portion of the second girder, a second longitudinal brace coupled with a second end portion of the first girder and a first end portion of the second girder, a first cross bracing assembly coupled with the first end of the first girder and the first end of the second girder, a second cross bracing assembly coupled with the second end of the first girder and the second end of the second girder, and a deck panel coupled with the first girder and the second girder. The second module can include a first girder having an upper coupling mechanism and a lower coupling mechanism, a second girder having an upper coupling mechanism and a lower coupling mechanism, a first longitudinal brace coupled with a first end portion of the first girder and a second end portion of the second girder, a second longitudinal brace coupled with a second end portion of the first girder and a first end portion of the second girder, a first cross bracing assembly coupled with the first end of the first girder and the first end of the second girder, a second cross bracing assembly coupled with the second end of the first girder and the second end of the second girder, and a deck panel coupled with the first girder and the second girder. The first upper fastening assembly can operate to secure the upper coupling mechanism of the first girder of the first module with the upper coupling mechanism of the first girder of the second module, the first lower fastening assembly can operate to secure the lower coupling mechanism of the first girder of the first module with the lower coupling mechanism of the first girder of the second module, the second upper fastening assembly can operate to secure the upper coupling mechanism of the second girder of the first module with the upper coupling mechanism of the second girder of the second module, and the second lower fastening assembly can operate to secure the lower coupling mechanism of the second girder of the first module with the lower coupling mechanism of the second girder of the second module.

Decking systems can also include ramp assemblies, as described elsewhere herein. In some cases, a decking system can be jacked up and placed on rollers. The rollers can provide a mechanism by which the decking system can be moved as an entire unit.

A decking system have sufficient strength to support the weight of a military tank. In some cases, the weight of a spreader is about 80 pounds. In some cases, a decking system may include spreaders spaced longitudinally along the length of the system. For example, there may be one spreader every six girders (per girder column) along the length of the decking system (e.g. as depicted in FIG. 6, there are four girder columns, and eight spreaders). In some cases, there may be one spreader every 46 feet (per girder column) along the length of the decking assembly.

Figure 4:
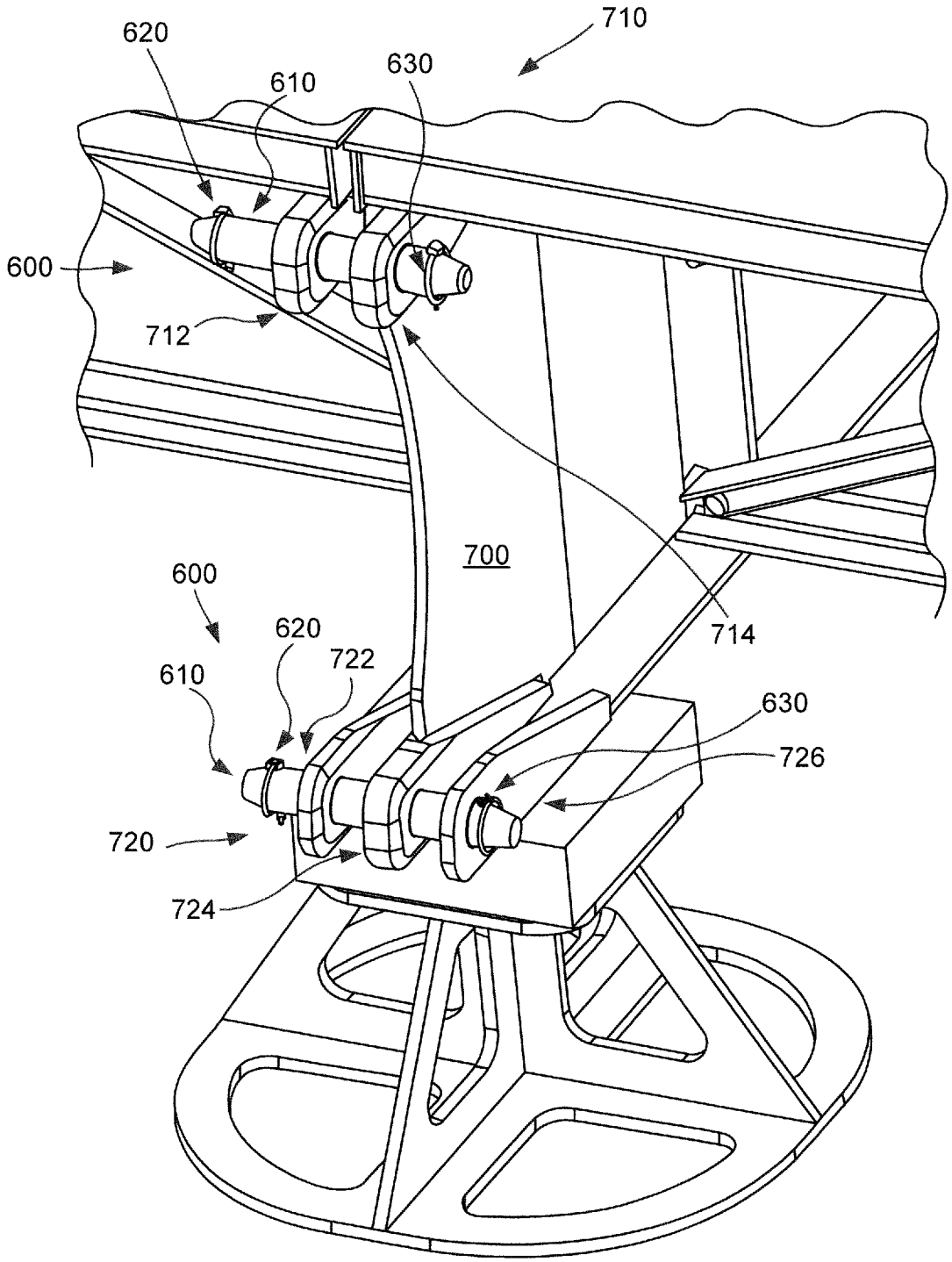
FIG. 4 depicts aspects of a method for assembling a decking system, according to certain embodiments of the invention.

FIG. 4 depicts aspects of a fastening assembly 600 having a pin 610, a first clip 620, and a second clip 630, which can be used to fasten two girders together. As shown here, a girder 700 can have an upper coupling mechanism 710 and a lower coupling mechanism 720. In this embodiment, upper coupling mechanism 710 has a first tab 712 and a second tab 714, and lower coupling mechanism 720 has a first tab 722, an second tab 724, and a third tab 726. Girder 700 could be coupled with an adjacent girder (not shown) having a complementary coupling mechanism arrangement. For example, the adjacent girder could have an upper coupling mechanism having a first tab, a second tab, and a third tab, and a lower coupling mechanism having a first tab and a second tab. In this way, the first tab 712 of the upper coupling mechanism 710 could fit between the first and second tabs of the upper coupling mechanism of the adjacent girder, and the second tab 724 of the upper coupling mechanism 710 could fit between the second and third tabs of the lower coupling mechanism of the adjacent girder. Likewise, the first tab 722 and the second tab 724 of the lower coupling mechanism 720 can receive therebetween a first tab of the lower coupling mechanism of the adjacent girder, and the second tab 724 and the third tab 726 of the lower coupling mechanism 720 can receive therebetween a second tab of the lower coupling mechanism of the adjacent girder. In some embodiments, individual girders can have a two tab upper coupling mechanism and a three tab lower coupling mechanism at one end of the girder, and a three tab upper coupling mechanism and a two tab lower coupling mechanism at the other end of the girder. In this way, multiple girders can be connected with each other in a linear fashion, thus resulting in a multi-girder row. Each of the tabs can have apertures, which can be configured to receive a pin therethrough. See, for example, see tab aperture 715 and tab aperture 727 as shown in FIG. 1.

Figure 5A:
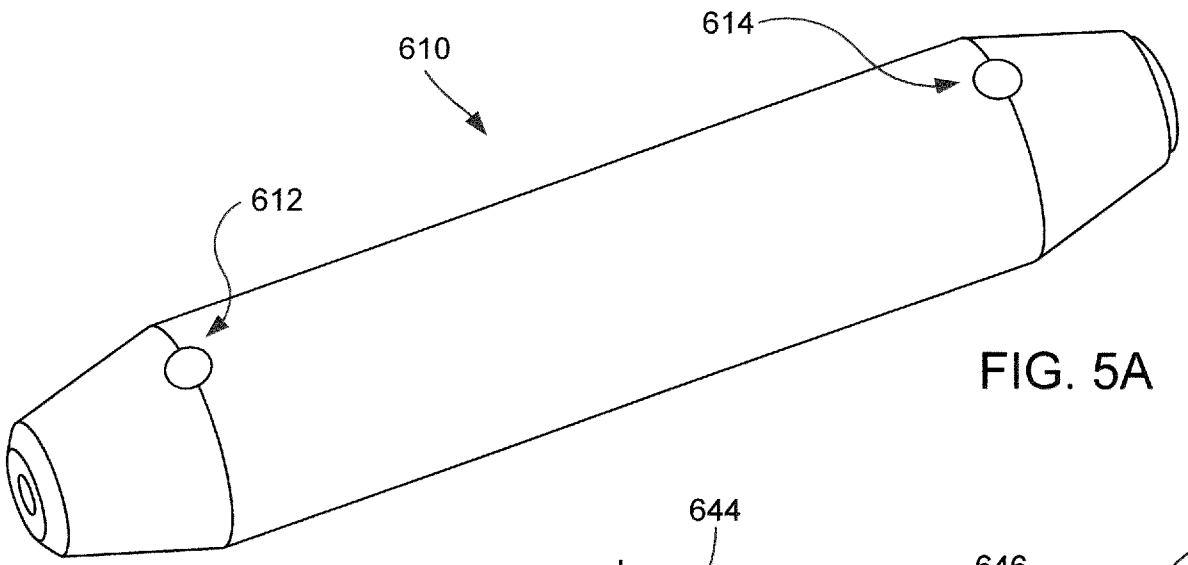
FIGS. 5A and 5B illustrate aspects of a fastening assembly for a decking system, according to certain embodiments of the invention.

FIG. 5A depicts aspects of a pin 610 according to embodiments of the present invention. As shown here, pin 610 includes a first aperture 612 therethrough at one end section of the pin, and a second aperture 614 therethrough at an opposing end section of the pine. Each of the apertures 612, 614 can be configured to receive a shank of a clip, including a usable length of a shank.

Figure 5B:
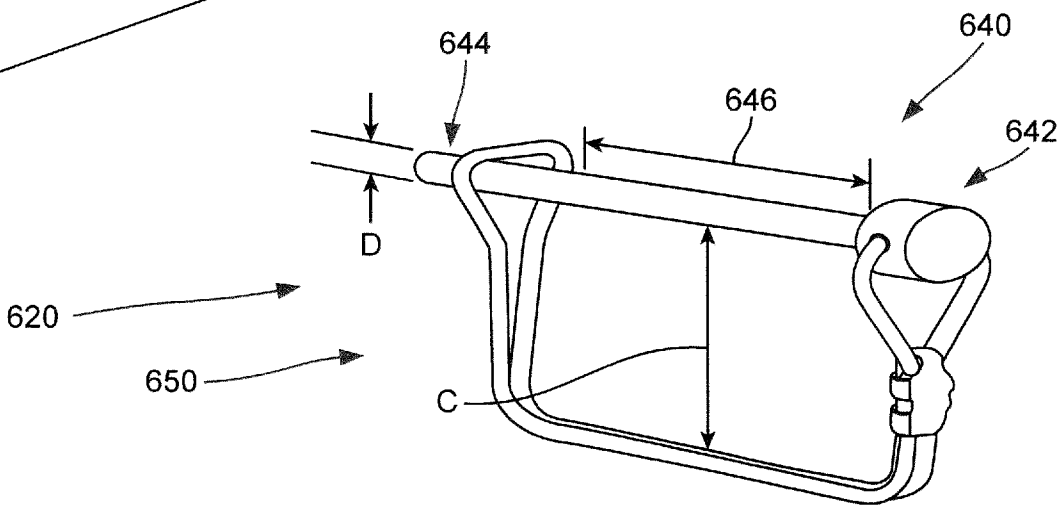

FIG. 5B depicts aspects of a clip 620, according to embodiments of the present invention. As shown here, clip 620 includes a nail 640 and a retainer 650. The nail 640 has a useable length 646, and includes a head 642 and a shank 644 having a diameter D. The retainer 650 includes a catch 652 that releasably engages shank 644 (which may involve slightly and reversibly bending retainer 650). Retainer 650 can pivot relative to shank 644 by virtue of the engagement between retainer 650 and head 642. Clip 620 is configured to provide a clearance distance C, so that pin 610 can be accommodated therein. The usable length 646 of shank 644 can be configured for placement within an aperture (e.g. 612, 614) of a pin 610.

In use, two girders can be engaged by interleaving tabs of one girder with tabs of another girder, such that apertures of the interleaved tabs are aligned to receive a pin therethrough. Once the pin is inserted through the tab apertures, a clip can be coupled with the pin by inserting a nail shank of the clip through an aperture of the pin, and looping a retainer catch of the clip about a distal end portion of the shank (e.g. opposite the proximal end portion of the nail shank, which is coupled to or continuous with a nail head), thereby putting the clip in a locked configuration.

Figure 7:
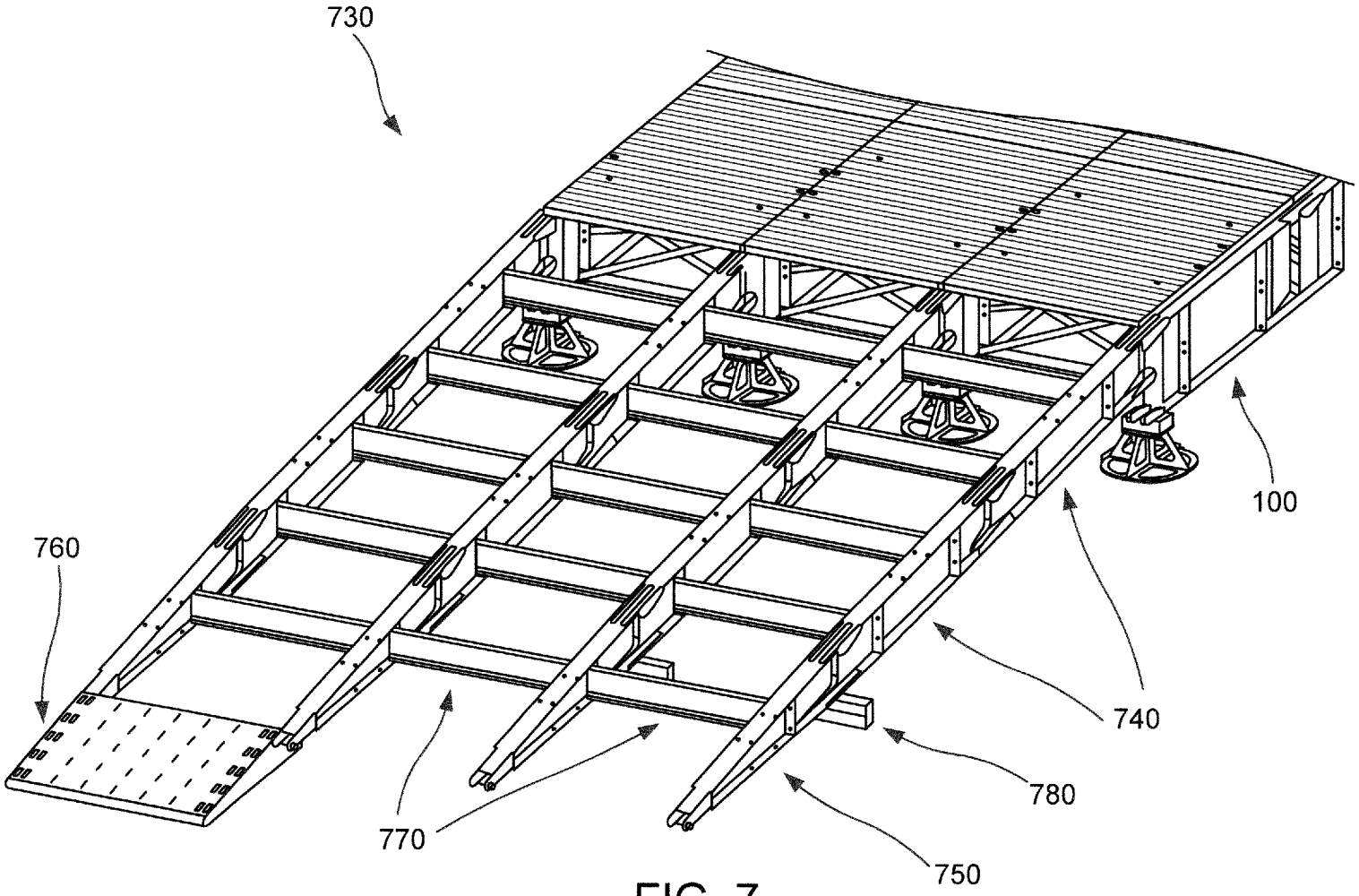
FIG. 7 depicts aspects of an end ramp assembly for a decking system, according to certain embodiments of the present invention.

FIG. 6 depicts a decking system 1000 having six bays, wherein each bay includes three modules. According to some embodiments, a single bay can be 8 feet long and 15 feet wide. According to some embodiments, a single bay may include four girders (e.g. four platform girders), two longitudinal bracing assemblies between each girder pair (e.g. for a total of six longitudinal bracing assemblies), two lateral cross bracing assemblies between each girder pair (e.g. for a total of six lateral cross bracing assemblies), thirteen 1½" hex flange screws configured for attaching all of the bracing with thirteen ½" nuts (e.g. thirty nine total 1½" hex flange screws and thirty nine total ½" nuts), three deck panels attached to the top of the girders (e.g. each deck panel coupled with, and optionally placed between, two girders), and four 3½" hex flange screws configured for bolting down each deck panels (e.g. 12 total bolts). Decking systems may include ramp builds or assemblies. FIG. 7 depicts a decking system having a ramp assembly 730. As shown here, ramp assembly 730 includes ramp beams or girders 740 (eight shown here), tapered ramp beams or girders 750 (four shown here), toe kicks 760 (one shown here), and transverse ramp braces (fifteen shown here). Ramp girders 740 can have upper and lower coupling mechanisms, which can be coupled with respective upper and lower coupling mechanisms of platform girders (e.g. platform girder 100) via interleaved tab coupling as described elsewhere herein. For example, tabs of a coupling mechanism of a ramp girder can be interleaved with tabs of a coupling mechanism of a platform girder, a pin can be placed within apertures of the tabs, and two clips can be engaged with the pin.

Figure 8:
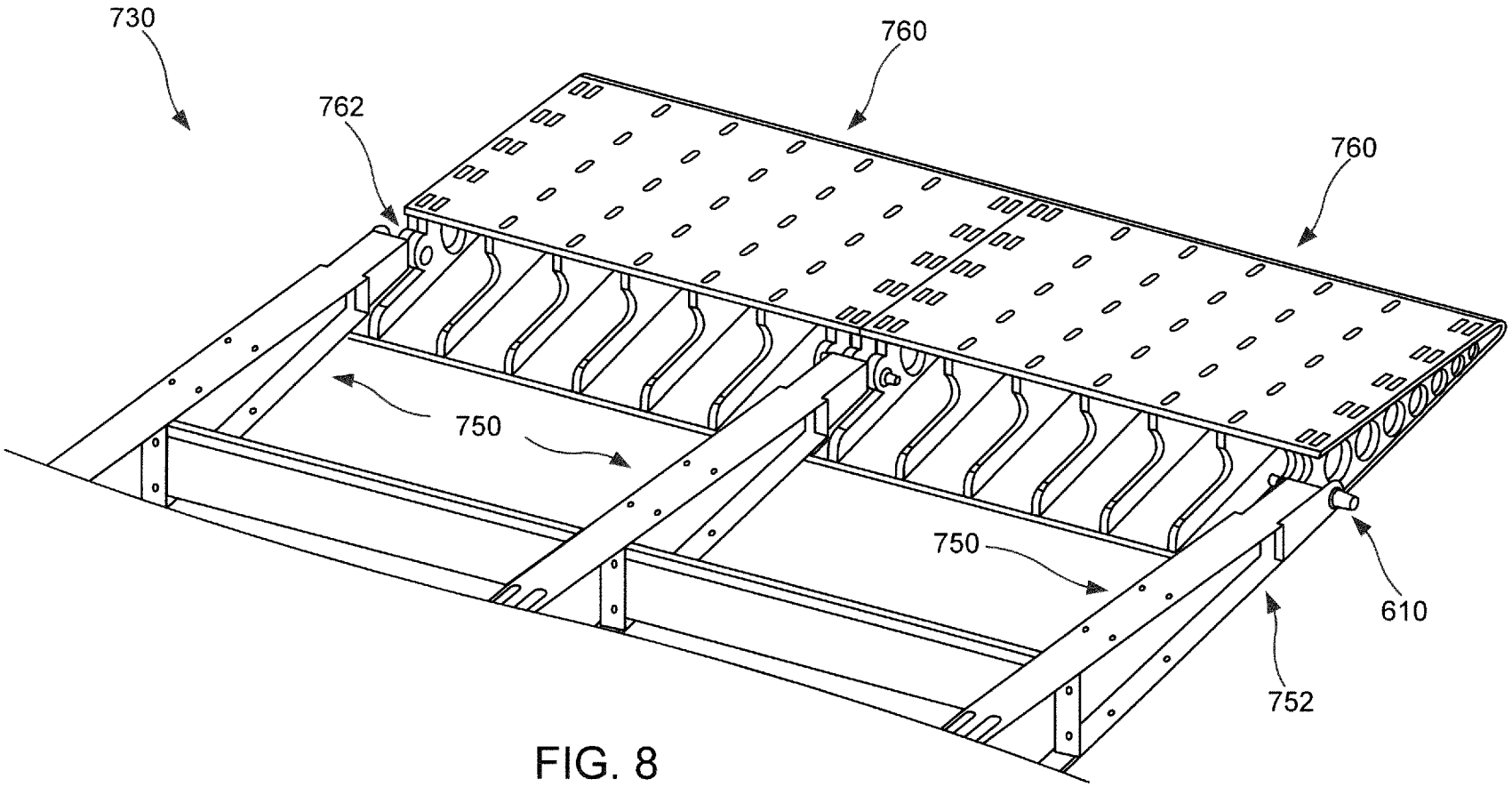
FIG. 8 depicts aspects of a ramp assembly for a decking system, according to certain embodiments of the present invention.

FIG. 8 provides an underside view of a distal portion of a ramp assembly 730. As shown here, toe kicks 760 can include tabs 762 having apertures, and such tabs can be interleaved with apertured tabs 752 of tapered ramp girders 750. When the toe kick tabs 762 and tapered ramp girder tabs 752 are engaged, a pin 610 can be placed within apertures of the tabs, and two clips can be engaged with the pin.

Figure 9:
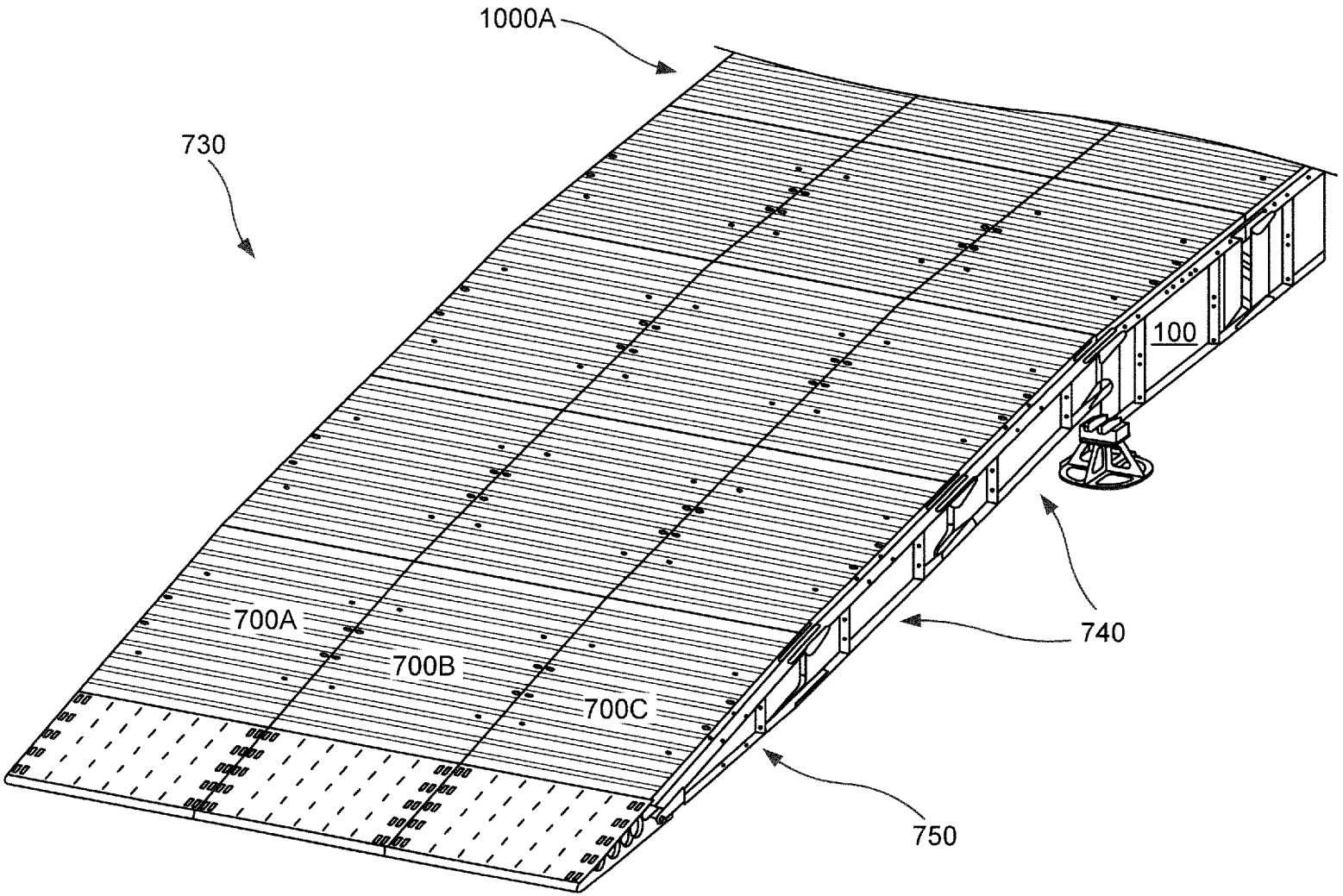
FIG. 9 depicts aspects of an end ramp assembly for a decking system, according to certain embodiments of the present invention.
Figure 11:
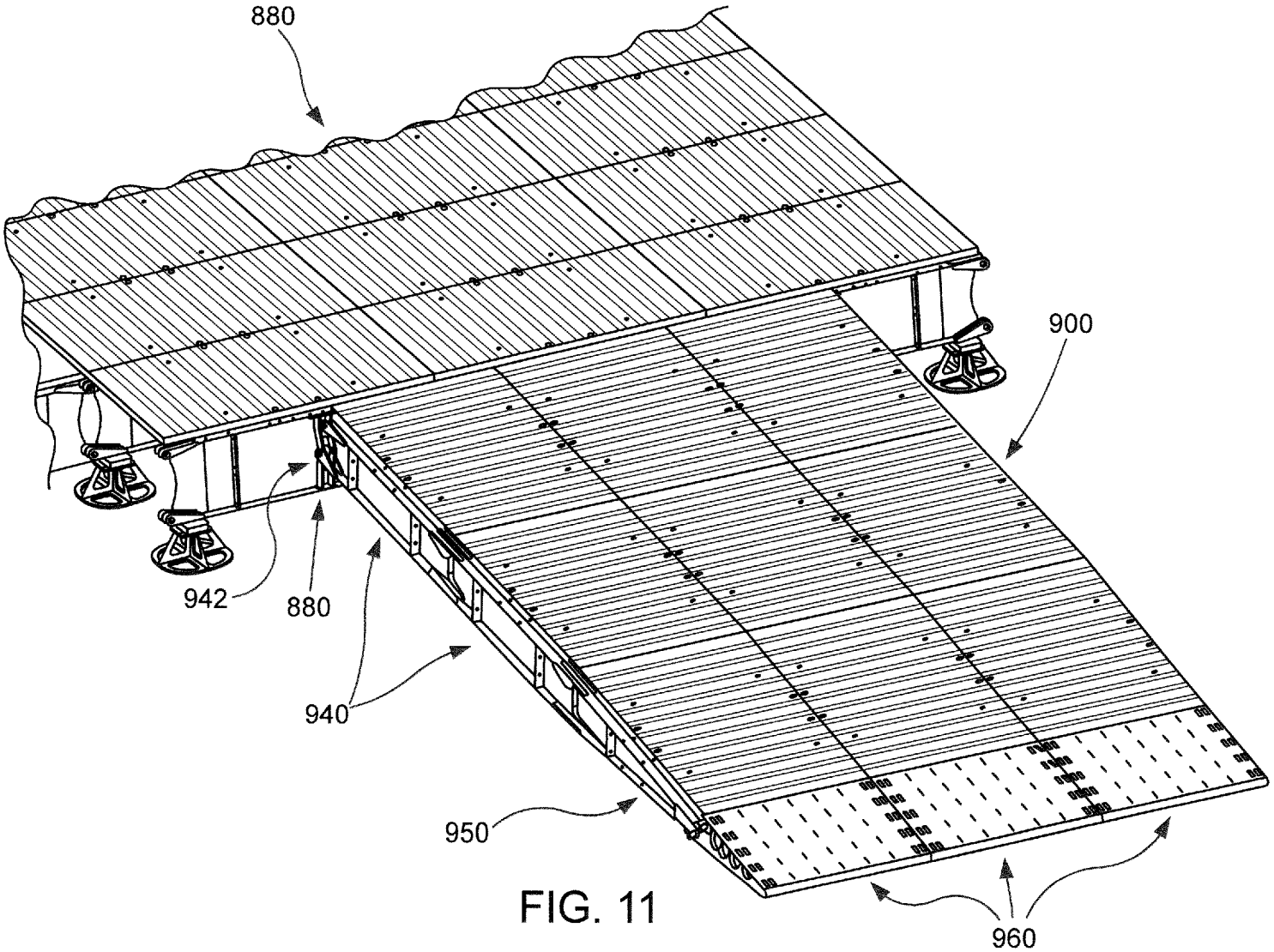
FIG. 11 depicts aspects of a side ramp assembly for a decking system, according to certain embodiments of the present invention.

FIG. 9 illustrates a fully assembled ramp assembly 730. In this configuration, ramp assembly 730 can be provided as an end ramp assembly. In other embodiments (e.g. as depicted in FIG. 11), a ramp assembly can be provided as a side ramp assembly. The ramp assembly 730 shown in FIG. 9 has three bays, each bay having three modules. Hence, ramp assembly 730 includes nine deck panels (e.g. 700A, 700B, 700C, and so on). Adjacent ramp girders 740 and tapered ramp girders 750 can be coupled with one another by virtue of apertured tab and pin/clip mechanisms, as described elsewhere herein.

According to some embodiments, a ramp girder can provide a main horizontal support for a ramp assembly, a tapered ramp girder can provide a horizontal support for ramp assembly, a deck panel, which may be aluminum or another metal, can provide a roadway portion of a ramp assembly (as well as a span or platform assembly), a toe kick can provide a ramp support toe to exit or enter the ramp assembly, and a transverse ramp brace can provide bracing for a ramp assembly.

Ramp assemblies can be incorporated into decking systems in a variety of ways. For example, to provide a decking system that spans across a river, a first ramp assembly can be placed on the near shore side of the river, a second ramp assembly can be placed on the far side of a river, and a decking platform or span assembly (e.g. as depicted in FIG. 6) can be placed across the river and between the first and second ramp assemblies.

As shown in FIG. 9, when assembling a decking system having a ramp assembly, a main span or decking platform assembly 1000A (e.g. main span 1000 as depicted in FIG. 6) can first be assembled, and then a ramp girder 740 can be coupled with a girder 100 of the main span 1000A, for example by first placing a pin through aligned tab apertures of the platform girder 100 and adjacent ramp girder 740. During assembly of the ramp assembly 730, one or more dunnage stacks 780 may be placed beneath girders of the ramp assembly, as depicted in FIG. 7. Any desired number of additional ramp girders 740 can be incorporated into the ramp assembly, and the ramp assembly 730 can be constructed using the dunnage placement technique as describe elsewhere herein. When constructing a ramp assembly, increasingly shorter dunnage stacks may be used, as construction of the ramp assembly approaches the toe kick components (e.g. 4 stack dunnage placed under ramp girders disposed nearest to the main span, and 2 stack dunnage, as depicted in FIG. 7, placed under ramp girders and/or tapered ramp girders closer to the toe kicks). With returning reference to FIG. 7, construction of the ramp assembly 730 may include adding transverse ramp braces 770 between ramp girder pairs, for example using twenty 1¾" bolts and twenty ½" nuts. Toe kicks can be coupled with tapered ramp beams as described elsewhere herein. As shown in FIG. 8, a single pin (with accompanying clips) can be used to couple a tapered ramp beam to two toe kicks. For example, a middle or central tapered ramp beam can be shared between two toe kicks. When the ramp assembly construction is completed, the ramp assembly can be raised with a forklift, and the underlying dunnage stacks can be removed. Ramp assembly deck panels, as depicted in FIG. 9, can be secured with the ramp girders and tapered ramp girders using bolts (e.g. four 4" bolts per deck panel).

Figure 10:
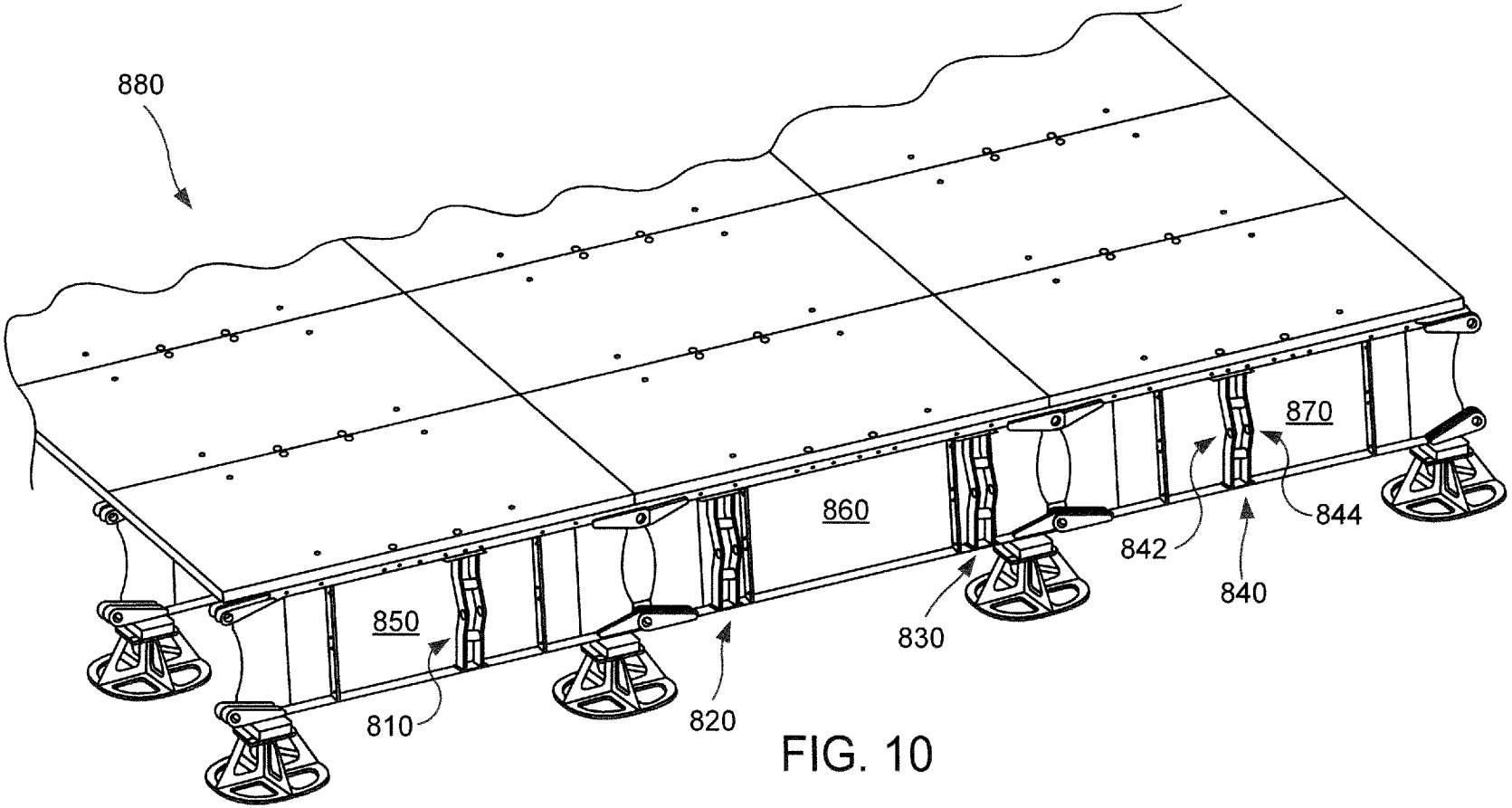
FIG. 10 depicts aspects of a side ramp assembly for a decking system, according to certain embodiments of the present invention.

In some cases, it may be desirable to attach a side ramp assembly with a decking platform or span assembly (e.g. decking platform 1000 depicted in FIG. 6). With reference to FIG. 10, a side ramp attachment mechanism 810 can be attached with a girder 850 of a decking platform 880. A side ramp attachment mechanism 820 and a side ramp attachment mechanism 830 can be attached with a girder 860 of a decking platform 880. A side ramp attachment mechanism 840 can be attached with a girder 870 of a decking platform 880. As shown here, a side ramp attachment mechanism can have apertured tabs, which can be coupled with apertured tabs of a ramp girder (e.g. ramp girder 740 depicted in FIG. 9). This coupling approach can be similar to the coupling approach described with reference to FIG. 4, whereby a fastening assembly (e.g. fastening assembly 600 having a pin 610, a first clip 620, and a second clip 630) can be used to fasten two girders together, via an interleaving tab configuration. For purposes of illustration, side ramp attachment mechanism 840 is shown as having a first apertured tab 842 (e.g. a tab with an aperture) and a second apertured tab 844 (e.g. a tab with an aperture). In some cases, a side ramp attachment mechanism can be coupled with a girder using two 1¾" bolts and two ½" nuts.

FIG. 11 depicts a completed side ramp assembly 900 attached with a decking platform 880. As shown here, side ramp assembly 900 includes ramp beams or girders 940, tapered ramp beams or girders 950, and toe kicks 960. Side ramp assemblies can also include transverse ramp braces, such as those shown in FIG. 7. With returning reference to FIG. 11, it can be seen that a lower coupling mechanism 942 of a ramp beam 940 can be coupled with the side ramp attachment mechanism 890. Ramp girders 940 can be coupled with side ramp attachment mechanisms via interleaved tab coupling as described elsewhere herein. For example, tabs of a ramp girder can be interleaved with tabs of a side ramp attachment mechanism, a pin can be placed within apertures of the tabs, and two clips can be engaged with the pin.

Although not shown here, it is understood that toe kicks 960 can include tabs having apertures, and such tabs can be interleaved with apertured tabs of tapered ramp girders 950. When the toe kick tabs and tapered ramp girder tabs are engaged, a pin can be placed within apertures of the tabs, and two clips can be engaged with the pin (similar to the fastening technique described in reference to FIG. 8). Ramp assembly 900 also includes multiple deck panels. In this configuration, the side ramp assembly 900 has three bays, each bay having three modules. Hence, ramp assembly 900 includes nine deck panels. Adjacent ramp girders 940 and tapered ramp girders 950 can be coupled with one another by virtue of apertured tab and pin/clip mechanisms, as described elsewhere herein.

Figure 12:
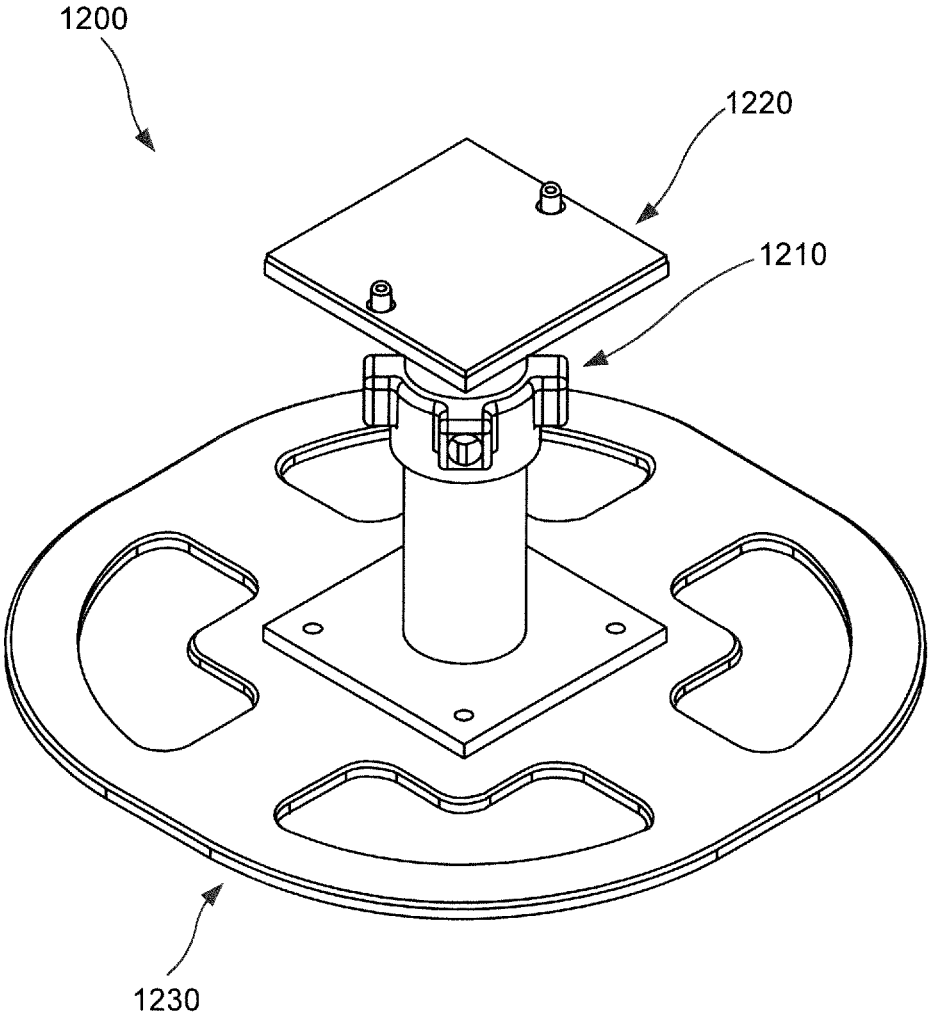
FIG. 12 illustrates aspects of a spreader fora decking system, according to certain embodiments of the invention.

In some embodiments, dunnage and/or spreaders can be adjusted or adjustable, for use with uneven ground or terrain, or for other reasons. FIG. 12 depicts an adjustable spreader 1200. As shown here, spreader 1200 includes a height adjustment mechanism 1210. By adjusting the height adjustment mechanism 1210, it is possible to raise and/or lower a support platform 1220 of the spreader 1200 relative to the ground and/or the base 1230 of the spreader.

Various combinations of decking main spans and decking ramp assemblies can be joined together as desired. A turning pad configuration for a decking system may include two or more main spans, an end ramp assembly, and a side ramp assembly. A landing pad configuration may include a main span and an end ramp assembly. A main span (gap crossing) configuration may include a main span. A ramp configuration may include a main span, an end ramp assembly, and a side ramp assembly. A ramp assembly is useful for offloading vehicles from a rail car bed, down to a road that is crossing the railroad tracks. If there is no road crossing the railroad tracks, it is possible to construct a decking platform or main span that serves as a road.

As will be appreciated by one of ordinary skill in the art, the present invention may be embodied as an apparatus (including, for example, a system, a machine, a device, and/or the like), as a method (including, for example, a business process, and/or the like), or as any combination of the foregoing.

Embodiments of the invention can be manifest in the form of methods and apparatuses for practicing those methods.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A multi-module decking system, comprising:

a first module, a second module, a first upper fastening assembly, a first lower fastening assembly, a second upper fastening assembly, and a second lower fastening assembly, wherein the first module comprises a first girder having an upper coupling mechanism and a lower coupling mechanism, a second girder having an upper coupling mechanism and a lower coupling mechanism, a first longitudinal brace coupled with a first end portion of the first girder and a second end portion of the second girder, a second longitudinal brace coupled with a second end portion of the first girder and a first end portion of the second girder, a first cross bracing assembly coupled with the first end of the first girder and the first end of the second girder, a second cross bracing assembly coupled with the second end of the first girder and the second end of the second girder, and a deck panel coupled with the first girder and the second girder, wherein the second module comprises a first girder having an upper coupling mechanism and a lower coupling mechanism, a second girder having an upper coupling mechanism and a lower coupling mechanism, a first longitudinal brace coupled with a first end portion of the first girder and a second end portion of the second girder, a second longitudinal brace coupled with a second end portion of the first girder and a first end portion of the second girder, a first cross bracing assembly coupled with the first end of the first girder and the first end of the second girder, a second cross bracing assembly coupled with the second end of the first girder and the second end of the second girder, and a deck panel coupled with the first girder and the second girder, and wherein the first upper fastening assembly secures the upper coupling mechanism of the first girder of the first module with the upper coupling mechanism of the first girder of the second module, the first lower fastening assembly secures the lower coupling mechanism of the first girder of the first module with the lower coupling mechanism of the first girder of the second module, the second upper fastening assembly secures the upper coupling mechanism of the second girder of the first module with the upper coupling mechanism of the second girder of the second module, and the second lower fastening assembly secures the lower coupling mechanism of the second girder of the first module with the lower coupling mechanism of the second girder of the second module.

2. The multi-module decking system of claim 1, further comprising a first spreader that provides support to the first girder of the first module, a second spreader that provides support to the second girder of the first module, a third spreader that provides support to the first girder of the second module, and a fourth spreader that provides support to the second girder of the second module.

3. The multi-module decking system of claim 2, wherein at least one of the first spreader, the second spreader, the third spreader, or the fourth spreader is an adjustable spreader.

4. The multi-module decking system of claim 1, further comprising a first spreader that provides support to the first end portion of the first girder of the first module, a second spreader that provides support to the first end portion of the second girder of the first module, a third spreader that provides support to the second end portion of the first girder of the second module, and a fourth spreader that provides support to the second end portion of the second girder of the second module.

5. The multi-module decking system of claim 4, wherein at least one of the first spreader, the second spreader, the third spreader, or the fourth spreader is an adjustable spreader.

6. The multi-module decking system of claim 1, wherein at least one of the first upper fastening assembly, the first lower fastening assembly, the second upper fastening assembly, or the second lower fastening assembly comprises a pin, a first clip, and a second clip.

7. The multi-module decking system of claim 6, wherein at least one of the first clip or the second clip comprises a nail and a retainer.

8. The multi-module decking system of claim 7, wherein the nail comprises a head and a shank.

9. The multi-module decking system of claim 8, wherein the pin comprises an aperture configured to receive the shank of the nail.

10. The multi-module decking system of claim 1, wherein the upper coupling mechanism of the first girder of the first module comprises a first tab having an aperture, a second tab having an aperture, and a third tab having an aperture, wherein the upper coupling mechanism of the first girder of the second module comprises a first tab having an aperture and a second tab having an aperture, wherein the first tab of the upper coupling mechanism of the first girder of the second module is positioned between the first tab and the second tab of the upper coupling mechanism of the first girder of the first module, wherein the second tab of the upper coupling mechanism of the first girder of the second module is positioned between the second tab and the third tab of the upper coupling mechanism of the first girder of the first module, and wherein a pin of the first fastening assembly extends through the aperture of the first tab of the first girder of the first module, the aperture of the first tab of the first girder of the second module, the aperture of the second tab of the first girder of the first module, the aperture of the second tab of the first girder of the second module, and the aperture of the third tab of the first girder of the first module.

11. A multi-module decking system, comprising:

a first module, a second module, an end ramp assembly, a first upper fastening assembly, a first lower fastening assembly, a second upper fastening assembly, a second lower fastening assembly, a third upper fastening assembly, and a fourth upper fastening assembly, wherein the first module comprises a first girder having an upper coupling mechanism and a lower coupling mechanism, a second girder having an upper coupling mechanism and a lower coupling mechanism, and a deck panel coupled with the first girder and the second girder, wherein the second module comprises a first girder having an upper coupling mechanism and a lower coupling mechanism, a second girder having an upper coupling mechanism and a lower coupling mechanism, and a deck panel coupled with the first girder and the second girder, wherein the first upper fastening assembly secures the upper coupling mechanism of the first girder of the first module with the upper coupling mechanism of the first girder of the second module, the first lower fastening assembly secures the lower coupling mechanism of the first girder of the first module with the lower coupling mechanism of the first girder of the second module, the second upper fastening assembly secures the upper coupling mechanism of the second girder of the first module with the upper coupling mechanism of the second girder of the second module, and the second lower fastening assembly secures the lower coupling mechanism of the second girder of the first module with the lower coupling mechanism of the second girder of the second module, and wherein the third upper fastening assembly and the third lower fastening assembly secure the first module with the end ramp assembly.

12. The multi-module decking system of claim 11, wherein the end ramp assembly comprises a first ramp girder having an upper coupling mechanism and a second ramp girder having an upper coupling mechanism, wherein the first girder of the first module has a second upper coupling mechanism, wherein the second girder of the first module has a second upper coupling mechanism, wherein the third upper fastening assembly secures the upper coupling mechanism of the first ramp girder with the second upper coupling mechanism of the first girder of the first module, and wherein the fourth upper fastening assembly secures the upper coupling mechanism of the second ramp girder with the second upper coupling mechanism of the second girder of the first module.

13. The multi-module decking system of claim 11, wherein the end ramp assembly comprises a toe kick.

14. The multi-module decking system of claim 11, wherein at least one of the third upper fastening assembly or the fourth upper fastening assembly comprises a pin, a first clip, and a second clip.

15. The multi-module decking system of claim 14, wherein at least one of the first clip or the second clip comprises a nail and a retainer, wherein the nail comprises a head and a shank, and wherein the pin comprises an aperture configured to receive the shank of the nail.

16. A multi-module decking system, comprising:

a first module, a second module, a side ramp assembly, a first upper fastening assembly, a first lower fastening assembly, a second upper fastening assembly, a second lower fastening assembly, a first side ramp attachment mechanism, and a second side ramp attachment mechanism, wherein the first module comprises a first girder having an upper coupling mechanism and a lower coupling mechanism, a second girder having an upper coupling mechanism and a lower coupling mechanism, and a deck panel coupled with the first girder and the second girder, wherein the second module comprises a first girder having an upper coupling mechanism and a lower coupling mechanism, a second girder having an upper coupling mechanism and a lower coupling mechanism, and a deck panel coupled with the first girder and the second girder, wherein the first upper fastening assembly secures the upper coupling mechanism of the first girder of the first module with the upper coupling mechanism of the first girder of the second module, the first lower fastening assembly secures the lower coupling mechanism of the first girder of the first module with the lower coupling mechanism of the first girder of the second module, the second upper fastening assembly secures the upper coupling mechanism of the second girder of the first module with the upper coupling mechanism of the second girder of the second module, and the second lower fastening assembly secures the lower coupling mechanism of the second girder of the first module with the lower coupling mechanism of the second girder of the second module, and wherein the first side ramp attachment mechanism and the second side ramp attachment mechanism secure the side ramp assembly with the first module, with the second module, or with the first module and the second module.

17. The multi-module decking system of claim 16, wherein the side ramp assembly comprises a first ramp girder having a lower coupling mechanism and a second ramp girder having a lower coupling mechanism, and wherein a third lower fastening assembly secures the lower coupling mechanism of the first ramp girder with the first side ramp attachment mechanism and a fourth lower fastening assembly secures the lower coupling mechanism of the second ramp girder with the second side ramp attachment mechanism.

18. The multi-module decking system of claim 17, wherein the first side ramp attachment mechanism and the second side ramp attachment mechanism are attached with the first girder of the first module.

19. The multi-module decking system of claim 17, wherein the first side ramp attachment mechanism is attached with the first girder of the first module and the second side ramp attachment mechanism is attached with the first girder of the second module.

20. The multi-module decking system of claim 17, further comprising a toe kick, wherein at least one of the first lower fastening assembly, the second lower fastening assembly, the third lower fastening assembly, or the fourth lower fastening assembly comprises a pin, a first clip, and a second clip, wherein at least one of the first clip or the second clip comprises a nail and a retainer, wherein the nail comprises a head and a shank, and wherein the pin comprises an aperture configured to receive the shank of the nail.

* * * * *